United States Patent [19]

Moody

[11] 4,037,582

[45] July 26, 1977

[54] OIL STOVE

[75] Inventor: Isaac N. Moody, Glenrothes, Scotland

[73] Assignee: Industrial & Marine Services (Scotland) Limited, Kirkcaldy, Great Britain

[21] Appl. No.: 635,292

[22] Filed: Nov. 26, 1975

[30] Foreign Application Priority Data

Nov. 27, 1974 United Kingdom ..... 51310/74

[51] Int. Cl.[2] ..... F24H 3/06

[52] U.S. Cl. ..... 126/116 R; 126/110 R; 261/123; 431/339

[58] Field of Search ..... 126/110 R, 110 B, 116 R; 431/338-340, 342; 261/123, 122

[56] References Cited

U.S. PATENT DOCUMENTS

| | | | |
|---|---|---|---|
| 2,336,666 | 12/1943 | Breese | 431/338 |
| 2,351,481 | 6/1944 | Breese | 431/340 |
| 2,371,520 | 3/1945 | Hayter | 431/340 |
| 2,376,172 | 5/1945 | Mueller | 126/110 R |
| 2,389,264 | 11/1945 | Livar | 126/116 R |
| 2,579,507 | 12/1951 | MacCracken | 126/110 R X |
| 2,893,374 | 7/1959 | Wilson, Sr. | 126/110 R |
| 2,944,598 | 7/1960 | Huntley et al. | 431/339 X |

FOREIGN PATENT DOCUMENTS

| | | | |
|---|---|---|---|
| 725,045 | 10/1931 | France | 261/123 |

*Primary Examiner*—William E. Wayner
*Assistant Examiner*—William E. Tapolcai, Jr.
*Attorney, Agent, or Firm*—Gerald J. Ferguson, Jr.; Joseph J. Baker

[57] ABSTRACT

An air-heating appliance is described which uses used engine lubricating oil as a fuel. The oil is fed by gravity to a burner consisting of an open cylindrical pan having a perforated side-wall and which is divided horizontally by an apertured fire plate. The pan is surrounded by a cylindrical casing which is spaced from the walls of the pan. A flue duct is arranged concentrically with and extends from the open top of the pan and is provided with jacket to define a heat exchange passage around the flue duct for air to be heated. Air flow through the heat exchange passage is induced by a fan and is directed and redirected in the passage by angled vanes disposed therein. Initially, the oil is ignited by an electric heating element which is switched off once self-ignition conditions pertain.

8 Claims, 1 Drawing Figure

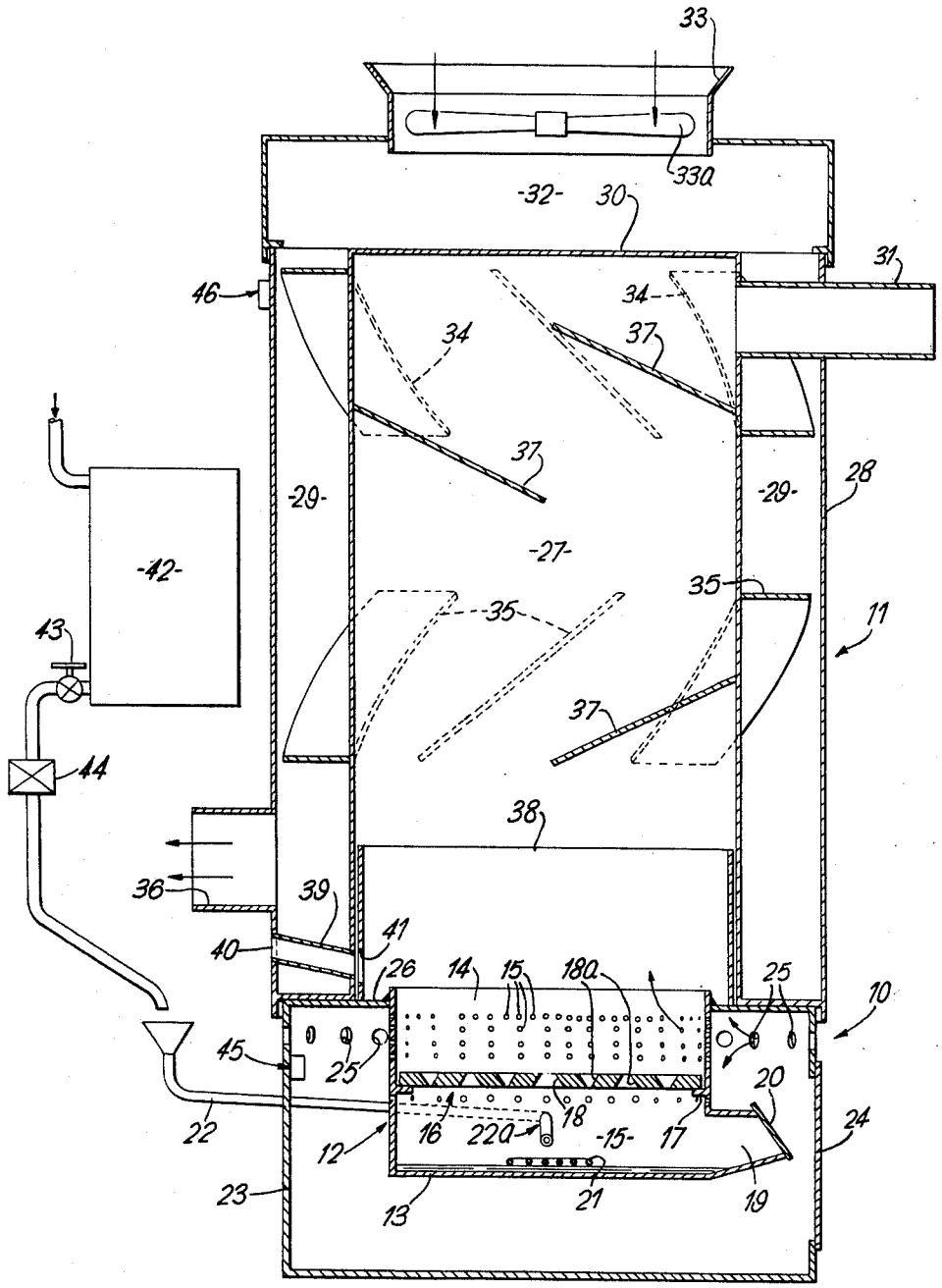
33
33a
-32-
30
31
46
34
34
37
37
-29-
-29-
28
-27-
-42-
35
35
11
43
37
44
38
36
39
41
40
26
14
15
18a
25
10
45
25
20
22
12
16
22a
18
-15-
17
24
23
13
21
19

OIL STOVE

This invention relates to an appliance for heating air or water.

The invention is particularly concerned with such an appliance incorporating combustion apparatus capable of burning used engine lubricating oil.

According to the present invention, there is provided a heating appliance incorporating combustion apparatus comprising an open pan having a floor portion and a cylindrical side-wall portion with perforations therein, the interior of said pan being divided by a fire plate in the form of a partition arranged generally parallel with and spaced from said floor portion, said partition having therein apertures which are arranged in concentric rows and are alternately convergent and divergent in the direction away from said floor portion of said pan the perforations in said side-wall portion being disposed in circumferential rows, both above and below said partition with the perforations in the uppermost row being smaller and more closely spaced than in the other rows, means for introducing oil into said pan at a point between said floor portion and said partition, heating means within said pan close to said floor portion, a flue duct extending from the open side of said pan, and heat exchange means surrounding said flue duct.

An embodiment of the present invention will now be described, by way of example, with reference to the accompanying drawing which is a sectional side elevation of an air-heating appliance in accordance with the present invention.

In the drawing, the heating appliance consists of a combustion apparatus or burner 10 for burning used engine-lubricating oil, and a heat exchanger 11. More particularly, the burner 10 consists of a cylindrical sheet-metal open pan 12 having a floor 13 and side wall 14, the latter being perforated by virtue of the provision therein of circumferential rows of air holes 15. The interior of the pan 12 is divided by a multi-apertured partition or fire plate 16 of cast iron which rests on a supporting flange 17 spaced above the floor 13. The fire plate 16 lies just above the lowermost row of holes 15 which may be regarded as providing "primary" air when the appliance is operating. The rows of holes 15 which are disposed above the fire plate 16 may be regarded as providing "secondary" air. In the uppermost row of holes 15, the holes are smaller and more closely spaced than in the other rows, this arrangement having been found to promote improved burning characteristics. For the purposes of burning used engine-oil, it has been found that the ratio of the total area of the "primary" air holes to the total area of the "secondary" air holes should be in the region of 1:5. In one example, the "primary" and larger "secondary" air holes are three millimeters diameter at 30 millimeters pitch, and the smaller "secondary" air holes are 2 millimeters diameter at 5 millimeters pitch. The apertures in the fire plate 16 are constituted by a central opening 18 and by concentric rings of further openings **18*a*. The ratio of the total area of the openings 18, to the plan area of the fire plate 16 should be in the region of 1:6. Also, the ratio of the total area of the openings 18, 18*a* to the total area of the "primary" air holes 15 should be in the region of 90:1. As is shown in the drawing, the openings 18, 18*a* are alternately convergent and divergent. This configuration effects mixing turbulence. A lower portion of the side wall 14 is provided with a short duct 19 the outer end of which has a door 20 giving access to the interior of the pan 12 for cleaning purposes. An electric heating element 21 is incorporated in the pan 12 close to the floor 13. An oil feed pipe 22 enters the pan 12 at a point 22*a* between the fire plate 16 and the floor 13.**

The body of the pan 12 is enclosed by a cylindrical casing 23 the walls of which are spaced from the pan 12 thereby to define a space below the floor 13 and an annular space around the exterior of the side-wall 14. A second door 24 is provided in the casing 23 to give access to the pan 12. A row of air inlet holes 25 is provided adjacent the top side-wall portion of the casing 23.

The top side of the casing 23 is constituted by an annular plate 26 whereupon rests a cylindrical assembly consisting of a flue duct 27 and jacketing wall 28 which together define a heat exchange passage 29. The upper end of the flue duct 27 is closed by a circular plate 30, the duct 27 communicating with an exhaust duct 31. The heat exchange passage 29 communicates with a manifold space 32 to which air to be heated is supplied through an intake mouth 33 by means of an air fan which is illustrated symbolically in the drawing at **33*a*. Angledvanes 34 and 35 are disposed in the heat exchange passage 29 and it will be seen in the drawing that in an upper set (34) the vanes are angled to direct inflowing air in one direction around the flue duct 27, and in a lower set (35) the vanes are angled to re-direct air in the opposite direction. Each of the vanes 34, 35 is in heat-conducting engagement (for example, by welding) with the external surface of the flue duct 27, but is spaced slightly from the internal surface of the jacketing wall 28 thereby to reduce heat transfer thereto by direct conduction. An outlet duct 36 is provided for off-take of heated air from the lower portion of the heat exchange passage 29. Baffles 37 are disposed in the flue duct 27 to increase the length of the flow-path of hot gases therethrough. The area, angle and reach of the baffles 37** is determined on a trial basis to achieve an optimal balance between combustion and heat exchange characteristics.

The lower portion of the wall of the flue duct 27 is shielded by a cylindrical heat shield 38 which is attached to the annular plate 26. A sighting tube 39 having a heat-proof transparent window 40 extends through the lower end portion of the assembly 11 in registration with an inspection aperture 41 in the heat shield 38.

The oil feed pipe 22 is supplied from a constant-head reservoir 42 incorporating a conventional float-and-valve arrangement (not shown) through an adjustable feed-rate valve 43 and a solenoid operated on/off valve 44. Temperature sensitive electrical switches are incorporated in the appliance at 45 and 46 to control operation of the solenoid valve 44, the electrical element 21 and the air fan **33*a*** as hereinafter explained.

Operation of the appliance is as follows. Initially, starting from cold, the solenoid valve 44 is closed, the element 21 is energised, and the fan **33*a* is off as dictated by relatively low temperatures at the switches 45 and 46. When the element 21 has reached a temperature above the fire point of the oil to be burned, and has also generally pre-heated the pan 13, the switch 45 (previously set to operate at an appropriate temperature by trial) opens the valve 44 whereupon oil from reservoir 42 reaches the point 22*a* at a rate previously set (again, by trial) at the valve 43. The oil drips onto the element 21 and the floor 13, vaporises and burns. This initial burning promotes further heating of the pan 12, the fire plate 16 and other parts of the appliance to a stage where a satisfactory induced air-flow is established and self-ignition occurs with a flame base principally on the upper side of the fire plate 16. Thus, the space below the fire plate 16 constitutes a vaporising chamber; and the space immediately above the fire plate 16 constitutes a main combustion chamber. Further combustion occurs within the flue duct 27 including the heat shield 38. The fan 33***a* is started by switch 46 when the upper portion of the flue duct 27 reaches a predetermined working temperature, and the element 21 is switched off. The heat shield 38 limits the temperature of the lowermost portion of the heat exchanger 11, and the position of the air intake openings 25 limits the temperature of the adjacent portion of the casing 23; in each case to a temperature compatible with reasonable safety from burning, and also compatible with paint finishes on the external surfaces of the casing 23 and jacketing wall 28.

In one modification of the above-described embodiment within the scope of the appended claims, the heat exchanger is adapted to carry water in place of air. In a further modification, a water-carrying heat exchange coil (not shown) is incorporated within the annular space of the casing 23. This provides a source of warmed water and also further safeguards against excessive external surface temperatures at the adjacent portion of the casing 23.

In a further modification, the pan 12 is provided with an excess-oil overflow pipe which extends from a point spaced a small distance up from the pan floor to the outside of the casing 23. The overflow pipe discharges to an overflow sensor, for example a container supported by a weight-sensitive electrical switch, which sensor is adapted to disconnect the solenoid valve 44 in the event of an oil overflow occurring. In a further modification, an open-work metal screen, for example of expanded sheet metal, is placed immediately below the fire plate 16 in order to improve further the burning characteristics by promoting additional turbulence.

I claim:

1. A heating appliance incorporating combustion apparatus comprising an open pan having a floor portion and a cylindrical side-wall portion with perforations therein, the interior of said pan being divided by a fire plate in the form of a partition arranged generally parallel with and spaced from said floor portion, said partition having therein apertures which are arranged in concentric rings and are alternately convergent and divergent in the direction away from said floor portion of said pan, said perforations in said side-wall portion being disposed in circumferential rows both above and below said partition with the perforations in the uppermost row being smaller and more closely spaced than in the other rows, means for introducing oil into said pan at a point between said floor portion and said partition, heating means within said pan close to said floor portion, a flue duct extending from the open side of said pan, and heat exchange means surrounding said flue duct.

2. An appliance as claimed in claim 11, including a casing having openings therethrough to permit air to reach the side-wall portion of the pan.

3. An appliance as claimed in claim 2 wherein said heat exchange means comprises a wall jacketing a portion of the flue duct thereby to define a heat exchange passage wherein air may flow in contact with the external surface of the flue duct.

4. An appliance as claimed in claim 3, including vanes arranged in the heat exchange passage to direct and redirect flow of air in the passage.

5. An appliance as claimed in claim 4, wherein the said vanes are in heat conducting engagement with the external surface of the flue duct and are spaced from the jacketing wall.

6. An appliance as claimed in claim 5, including baffles incorporated in the flue duct to increase the path-length of gases flowing therethrough.

7. An appliance as claimed in claim 6, wherein the ratio of the total area of perforations in the said side-wall portion of the pan between the side partition and the floor portion to the total area of the perforations in the side-wall portion on the opposite side of the partition is approximately 1:5.

8. An appliance as claimed in claim 7, wherein the ratio of the total area of the perforations in the said side-wall portion of the pan between said partition and the floor portion to the total area of the apertures in the partition is approximately 1:90.

* * * * *